United States Patent [19]

Perry

[11] 4,239,049

[45] Dec. 16, 1980

[54] ASHTRAY

[76] Inventor: George W. Perry, c/o Fitch, Even & Tabin 135 S. LaSalle St., Chicago, Ill. 60603

[21] Appl. No.: 37,500

[22] Filed: May 10, 1979

[51] Int. Cl.[2] ..... A24F 19/14

[52] U.S. Cl. ..... 131/235 ST; 131/240 R

[58] Field of Search ..... 131/235 R, 231, 237, 131/240, 235 ST, 241, 256

[56] References Cited

U.S. PATENT DOCUMENTS

| | | | |
|---|---|---|---|
| 2,771,884 | 11/1956 | Aghnides | 131/235 ST |
| 3,135,268 | 6/1964 | Fleming | 131/235 R |

FOREIGN PATENT DOCUMENTS

| | | | |
|---|---|---|---|
| 629810 | 9/1949 | United Kingdom | 131/235 R |

*Primary Examiner*—Stephen C. Pellegrino

*Attorney, Agent, or Firm*—Fitch, Even, Tabin, Flannery & Welsh

[57] ABSTRACT

The invention relates to an ashtray having improved cleaning and safety features. The ashtray comprises an outer shell in which is disposed a tray having a centrally located pedestal. The ashtray includes cylindrical openings for rapidly snuffing out smoking elements and also grooves formed in the tray which function to facilitate snuffing out the smoking elements.

7 Claims, 6 Drawing Figures

ASHTRAY

The present invention relates generally to an improved ashtray and, more particularly, it relates to an ashtray having improved cleaning and safety features.

Of course, there are a wide variety of ashtrays which have been and are provided by the marketplace and the prior art. Ashtrays have had various designs and shapes and have provided different features for the handling of smoking elements such as cigarettes, cigars and the like. Examples of ashtrays disclosed in the prior art are disclosed in U.S. Pat. Nos. 2,480,816; 2,586,466; 2,710,611; 2,771,884; 2,777,449; 2,974,821 and 4,027,683. In general, these previously known ashtrays have provided an untidy appearance, after use, have been different to clean or have not been safe in preventing smoke and fires. A further problem with heretofore known ashtrays is that smoking elements continue to emit smoke when carelessly put out.

A principal object of this invention is the provision of a new and improved ashtray. A further object of the invention is to provide an ashtray which can be readily cleaned and which is safe in use. A still further object of this invention is the provision of an ashtray which functions to not only be readily cleaned but to rapidly snuff out smoking elements and thereby provide safety in the use of the ashtray.

Further objects and advantages of the present invention will be apparent from reference to the accompanying drawings wherein.

Figure 1:
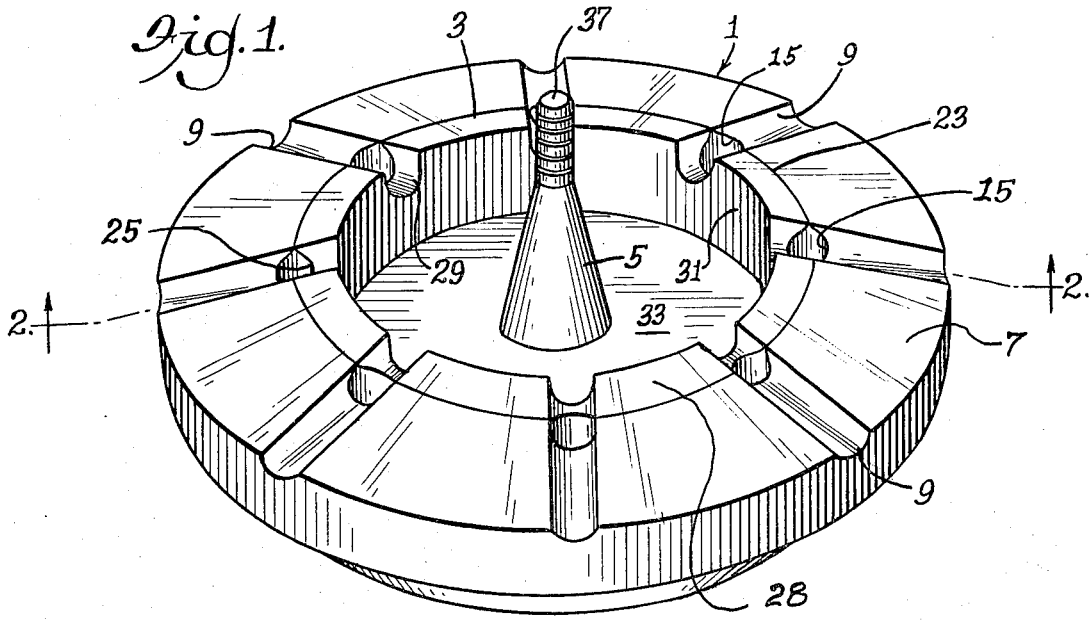
FIG. 1 is a perspective view of one embodiment of the ashtray of the invention.

Referring now to the drawings, the ashtray of the invention generally comprises an outer shell 1 within which is disposed a movable tray 3, and a pedestal 5 disposed centrally of the tray 3. The various elements of the ashtray can be manufactured from different materials which, of course, should not be combustible at the temperatures normally encountered with smoking elements such as cigarettes, cigars and the like. It will be appreciated that the ashtray can have various geometric configurations, although the drawings disclose a circular configuration for the ashtrays shown in FIGS. 1 to 3, inclusive, and the configuration for the ashtray shown in FIGS. 4 to 6, inclusive.

The outer shell 1 includes a flat, generally horizontally extending surface 7 which, in the illustrated embodiment of FIG. 1, is circular. A plurality of grooves 9 are disposed in the surface 7 about the periphery of the outer shell and these grooves 9 extend radially outwardly. The grooves are proportioned to accommodate a smoking element and may be of various sizes depending upon the particular smoking element which is utilized. As would be expected, these grooves can be enlarged for accommodating cigars, but if the ashtray is primarily designed for cigarettes, the grooves 9 would be expected to be smaller in size.

The outer shell 1 further comprises a vertically extending wall 11 which depends downwardly from the inner edge of the horizontally extending surface 7. The wall, in the illustrated embodiment, connects to a bottom 13, the wall 11 and bottom 13 providing a cavity in which is received the tray 3.

Disposed at the inner end of the grooves 9 and in the vertically extending wall 11 are a plurality of recesses 15. As shown in FIG. 3, the recesses 15 are generally semicircular, although they may be different shapes. The recesses extend downwardly to a point adjacent the bottom 13 of the outer shell 1, as is particularly shown in FIG. 2 of the drawings.

Figure 2:
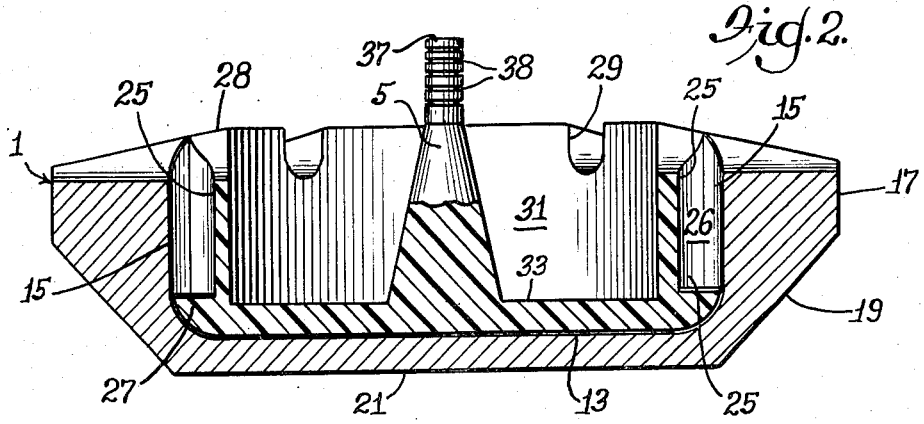
FIG. 2 is a cross-sectional view of the ashtray shown in FIG. 1 taken along lines 2—2 of FIG. 1.
Figure 3:
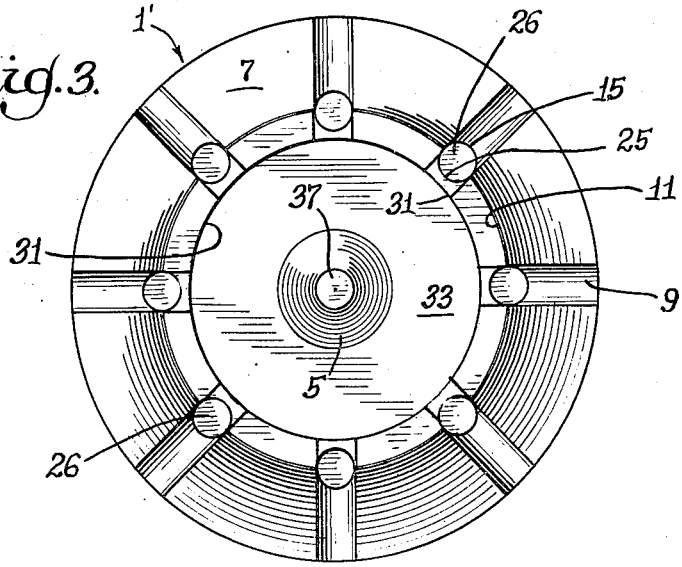
FIG. 3 is a top view of the ashtray shown in FIG. 1.

The outer shell 1, at the outer edge of the flat surface 7, connects to a skirt 17 which depends from the flat surface 7 in the particular embodiment shown in FIGS. 1 and 2, the skirt tapers inwardly, as shown at 19 of the drawings, and connects to a bottom 21 which, of course, sits upon a table or other surface, as desired. It is again noted that the outer configuration of the outer shell 1 can be of different geometric configurations than the generally circular construction shown in the drawings.

The tray 3, which has been pointed out sits within the outer shell 1, comprises an outer wall 23 which is in close proximity to the wall 11 of the outer shell. The outer wall 23 of the tray 3 has formed therein a plurality of complementary recesses 25 which match with the recesses 15 in the outer shell 1 and, in the illustrated embodiment, the recesses 15 and 25 form cylinders 26 which extend vertically between the outer shell 1 and the tray 3. These cylinders are designed and proportionated to readily receive the smoking elements but are not overly large with respect to the smoking element. The smoking element can be vertically gently inserted into the cylinders 26 which, upon doing so, function to starve the smoking elements of oxygen and cause them to be snuffed out without tamping. The height of the cylinders can vary but, desirably, they will be of a height of the order of $\frac{3}{4}$ inches for the cigarettes.

Disposed at the bottom of the recesses 25 are outwardly extending ears or ejector tabs 27 which are proportioned to close off the bottom of the recesses 25 and to extend into the recesses 15. The ears 27 operate to clean the cylinders 26 formed by recesses 15 and 25 upon vertical movement of the tray 3. Thus, the ears 27 operate to effectively clean the cylinders 26 when the tray 3 is removed from the outer shell 1.

A flat and generally horizontally extending surface 28 is located at the upper end of the outer wall 23 of the tray 3 and this surface has a plurality of grooves 29 formed therein which are aligned with the grooves 9 in the outer shell 1. These grooves 29 terminate at one end at the recesses 25, in each case. The dimensions of the grooves 29 are important in providing the safety features of the ashtray and, in this connection, the grooves 29 are dimensioned to compress the smoking element for which the ashtray is designed and desirably have a depth greater than the cross section of the smoking element. Thus, when the smoking element is pressed in the grooves 25 if the smoking element is burning it will be rapidly snuffed out when it reaches the inner edge of the grooves 29.

The tray 3 also has an inner wall 31 which depends from the generally flat surface 28 of the tray 3 down to a bottom 33. Centrally of the bottom is disposed the pedestal 5 which, at its upper end, is provided with gripping means 37 by means of which the tray 3 can be lifted from the outer shell 1 and manipulated, as desired, to lift the tray. At the same time, when the tray 3 is removed, the ears 27 function to clean the cylinders 26 defined by the recesses 15 and 25 thereby readily removing any smoking elements which are in the cylinder. The pedestal 5 desirably extends above the tray 3 so as to permit more ready grasping of the gripping means 37. The gripping means, of course, can be in various forms as for example a knob or mere indentations 38, as shown, to facilitate grasping of the pedestal 5 and removal of the tray 3.

Figure 4:
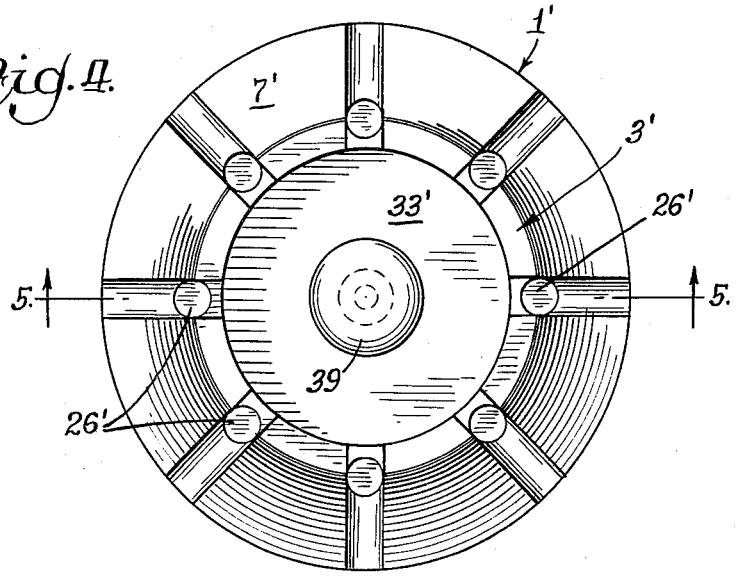
FIG. 4 is a top view of a second embodiment of the invention but which incorporates the features of the ashtray shown in FIG. 1.
Figure 5:
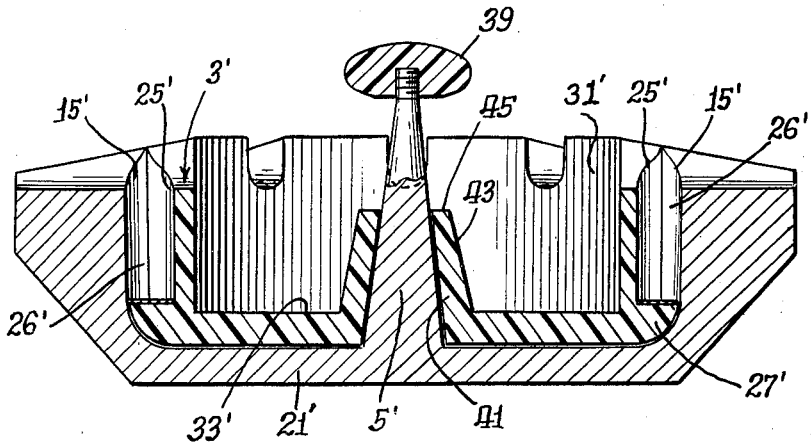
FIG. 5 is a cross-sectional view of the ashtray shown in FIG. 4 taken along lines 5—5 in FIG. 4.
Figure 6:
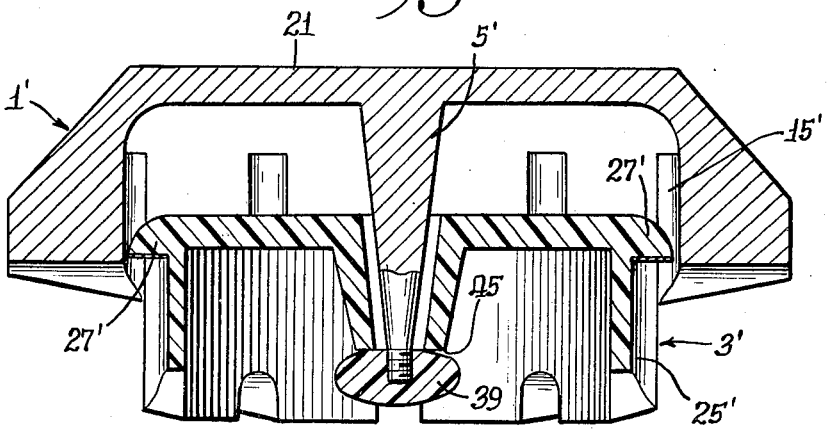
FIG. 6 is a view showing the ashtray in FIG. 5 inverted whereby the tray in the ashtray moves upon a pedestal down against a knob effecting self-cleaning of the ashtray, as will be hereinafter described.

An alternate embodiment of the invention is disclosed in FIGS. 4 through 6, inclusive, and, in the drawings, like numbers are used to designate corresponding parts shown in the previously described embodiment except that they are differentiated by the symbol prime (′). However, the embodiment of the ashtray shown in FIGS. 4 through 6 includes certain differences which should be described and in the alternate embodiment of the invention, the pedestal 5′ is affixed to the bottom 21′ of the outer shell 1′ and terminates at its apex in a knob 39 which is threadedly attached to the pedestal 5′. In addition, there is provided a journal element 41 which is located centrally of the bottom 33′ of the tray 3′. The journal element 41 includes an upstanding section 43, generally frustoconical in shape, through which extends the pedestal 5′. Thus, the tray 3′ is allowed to move the journal element 41 upwardly relative to the pedestal 5′. The movement of the tray 3 is limited by the top end 45 of the journal element 41 which contacts the knob 39, as when the ashtray is inverted, as shown in FIG. 6. Desirably, the distance between the top end 45 of the journal element 41 and the knob 39 is less than the height of the inner wall 31′ of the tray 3. With this proportioning, the tray, when the ashtray is inverted, will hit against the knob 39 and the ears 27′ and the tray 3 will not clear the recesses 15′ but, at the same time, the ears can function to clean any smoking materials which are in the cylinders 26′ formed by the recesses 15′ and 25′. It will thus be seen that the ashtray can be readily cleaned. Further, upon uprightning of the ashtray, the tray 3 will automatically return to its proper position in the outer shell 1′.

From the foregoing description of the embodiments of the invention, it will be apparent that an improved ashtray with safety features is provided which can be readily cleaned and can be easily handled.

The various features of the invention are set forth in the appended claims.

What is claimed is:

1. An ashtray comprising, in combination, (a) an outer shell having a generally flat, horizontally extending surface with an outwardly extending groove formed therein for receiving a smoking element, said outer shell also having a vertically extending wall depending downwardly from the inner edge of said horizontally extending surface, said wall having a downwardly extending recess positioned at the inner end of said outwardly extending groove, (b) a tray within said outer shell comprising an outer wall adjacent said wall of said outer shell, said outer wall having a complementary recess formed therein opposite the recess in said wall of said outer shell, an ear extending outwardly from the complementary recess in said outer wall and into the downwardly extending recess in said outer shell, said tray having a generally flat, horizontally extending surface connected at the upper end of said outer wall, said surface having a groove therein aligned with said outwardly extending groove in the surface of said outer wall, said tray also having an inner wall depending from said generally flat, horizontally extending, surface and connected to a bottom, and (c) a pedestal positioned centrally of said bottom, said pedestal having a grip positioned at the top thereof for manipulating the ashtray, whereby said tray may be caused to move relative to said outer shell and said ears can automatically clear any materials in said recesses.

2. An ashtray in accordance with claim 1 wherein said pedestal is connected to said bottom whereby said tray may be lifted from said outer shell.

3. An ashtray in accordance with claim 1 wherein said recess and complementary recess generally form a cylinder and said ear provides a closed bottom for said cylinder.

4. An ashtray in accordance with claim 1 wherein said groove in the surface of said tray is dimensioned to compress the smoking element and has a depth greater than the cross section of the smoking element.

5. An ashtray comprising, in combination, (a) an outer shell having a generally flat, horizontally extending, surface with an outwardly extending groove formed therein for receiving a smoking element, said surface having a skirt extending downwardly from the outer edge thereof and connected to a bottom, said outer shell also having a vertically extending wall depending downwardly from the inner edge of said horizontally extending surface, said wall having a downwardly extending recess positioned at the inner end of said outwardly extending groove, (b) a tray within said outer shell comprising an outer wall adjacent said wall of said outer shell, said outer wall having a complementary recess formed therein opposite the recess in said wall of said outer shell, an ear extending outwardly from the complementary recess in said outer wall and into the downwardly extending recess in said outer shell, said tray having a generally flat, horizontally extending surface connected to said outer wall, said surface having a groove therein aligned with said outwardly extending groove in the surface of said outer wall, said tray also having an inner wall depending from said generally flat horizontally extending surface and connected to a bottom, a journal element positioned centrally of said bottom and connected thereto, and (c) a pedestal connected centrally of the bottom of said outer shell and extending through said journal element, said shaft having a knob positioned at the top thereof, said knob being larger than the opening in said journal element whereby said tray may move on said pedestal away from said outer shell.

6. An ashtray in accordance with claim 5 wherein said knob is spaced from the upper end of said journal element a distance less than the height of the recess in said wall of said outer shell.

7. An ashtray in accordance with claim 6 wherein said groove in the surface of said tray is dimensioned to compress the smoking element and has a depth greater than the cross section of the smoking element.

* * * * *

UNITED STATES PATENT AND TRADEMARK OFFICE

CERTIFICATE OF CORRECTION

PATENT NO. : 4,239,049

DATED : December 16, 1980

INVENTOR(S) : George W. Perry

It is certified that error appears in the above—identified patent and that said Letters Patent is hereby corrected as shown below:

Column 1, line 16, "different" should read -- difficult --.

Signed and Sealed this

Tenth Day of November 1981

[SEAL]

*Attest:*

GERALD J. MOSSINGHOFF

*Attesting Officer*

*Commissioner of Patents and Trademarks*